United States Patent [19]

Bart

[11] 4,349,987

[45] Sep. 21, 1982

[54] DOLL WHICH RISES FROM PRONE TO STANDING POSITION

[76] Inventor: Philip D. Bart, 9864 NW. 13th Ct., Coral Springs, Fla. 33065

[21] Appl. No.: 169,675

[22] Filed: Jul. 17, 1980

[51] Int. Cl.[3] ..... A63H 11/00

[52] U.S. Cl. ..... 46/265; 46/120; 46/266

[58] Field of Search ..... 46/120, 121, 129, 134, 46/150, 264, 265, 266

[56] References Cited

U.S. PATENT DOCUMENTS

| | | | |
|---|---|---|---|
| 3,128,575 | 4/1964 | Stanetzki | 46/120 |
| 3,500,577 | 3/1970 | Bart | 46/134 |
| 3,728,815 | 4/1973 | Tomiyama | 46/134 X |

FOREIGN PATENT DOCUMENTS

| | | | |
|---|---|---|---|
| 169675 | 8/1931 | France | 46/134 |
| 130922 | 1/1929 | Switzerland | 46/134 |

*Primary Examiner*—F. Barry Shay

*Attorney, Agent, or Firm*—Daniel M. Rosen

[57] ABSTRACT

A robot doll with an internal drive unit for automatically causing the doll in prone face-down position to bend at the waist until reaching a semi-erect position, then to straighten-up to a standing position, and then to wobble from side-to-side, or to simulate walking, and-/or to fall down. A first switch actuates the doll to move from prone position to standing. A reversing switch, actuated as the doll stands, reverses the drive motor to complete standing action. A rod is reciprocated in and out of at least one foot to simulate walking actions and to cause the doll to tip. An interior frame carrying an electric motor and gears is loosely mounted and a cam mounted thereon causes the frame, hence the doll, to wobble while in the standing position. The doll eventually falls from standing position and impacts its pivoted arms on the support surface. This opens a reversing switch and starts the series of moves over again.

18 Claims, 18 Drawing Figures

DOLL WHICH RISES FROM PRONE TO STANDING POSITION

BACKGROUND OF THE INVENTION

This invention relates to toys which move about by themselves once having been started, and particularly to dolls which have electrical or other power supplies inside the body for causing parts of the body to move or carry out various functions. It is known in the prior art to provide within a doll a tape recorder, for example, which when started will cause the doll to appear to talk or cry or sing. It is also known to provide electrical or spring wind-up drive means to cause the arms or head of a doll to move according to some predetermined program of motion. Finally, it is known to provide electrically driven wheels or other means in the feet or base of a doll to cause it to move about, except that such movement in dolls or robots traditionally appears awkward or stilted, because reproduction of all the basic human joints involved in walking, and coordinating these joints to duplicate human movement has thus far been essentially impossible and obviously impractical in regard to manufacturing a saleable product in the toy industry. Dolls or toys of the type described above share the important feature of being essentially upright and stable in the upright orientation. What is not heretofore known is a robot doll which can simulate the well known difficulty of human babies in getting up to a standing position from a prone position. During the process of learning to stand up and walk, obviously babies fall and arise repeatedly, and it is this phenomenon which children can readily identify with if such a robot toy existed which reproduced this age old struggle and accomplishment of all infants. The present invention is a novel robot mechanism having the outer shape of a human infant, and the capability of standing up from a prone position in a manner simulating that of a real infant, followed by an unstable movement while in the upstanding position also simulating the instability of an infant who has just learned to stand. This robot is further programmed to eventually fall down as real infants at this stage of development do, and to arise by itself and repeat the above-mentioned movements. The new robot doll performs the movements of arising, shuffling about, and falling down, by an internal system comprising an electric motor, numerous gears, cams and levers mounted in the torso, and an electric battery power source located in the legs. This invention involves use not only of the electric motor to drive various members in precise motion patterns, but application of gravity, inertia and balance or imbalance in general combined with the electric motor to cause the robot to achieve the unusual behaviour described earlier.

The batteries could be placed in a variety of locations within the robot, however, in the preferred embodiment illustrated in the drawings appended hereto, the batteries are placed in the legs which placement became a component of the overall design and configuration to provide the necessary balance or imbalance as will be described later.

The doll of this invention begins in a prone position. The drive system causes the doll to bend at the waist so that the mid section begins to rise while the feet and hands remain on the ground. The mid section rises higher until the doll forms an inverted V-shape. At a certain point in this movement, the center of gravity moves rearward and the V-shaped figure tips backward into a stable position while the torso is still bent in half. With the legs now in a vertical and upright position, and the head and arms lifted off the ground, the arms no longer rest against the ground, and thus are free to move slighly pursuant to an internal spring force. This arm movement signals the motor to reverse its drive and unbend the torso, which effectively opens the V-shape between the legs and the upper body as the upper body bends upward relative to the legs until it is in a vertical position aligned generally with the legs. The doll in the upstanding position then shuffles about due to an intermittent tipping motion of the torso relative to the legs, and eventually the movement is sufficiently great to unbalance the standing figure and cause it to fall forward, after which the standing up procedure is repeated. In a second preferred embodiment the intermittent tipping movement of the torso is modified to cause the legs or parts thereof to move and cause the doll to walk or at least shuffle in one direction simulating the movement of an infant learning to walk. The forward movement capability can be combined with the earlier described program causing the doll to fall down, so that it can again get up.

In this invention it is significant not only that the doll can perform the movements described, but that the mechanism to achieve this motion is extremely simple and sufficiently inexpensive for the doll to be manufactured profitably and sold in the toy industry. More particularly, the present invention provides remarkable simulation of the falling down, getting up and initial walking movements of human infants which has not heretofore been provided in robot dolls. The above-mentioned switch means actuated by movement of the arms when the doll partially arose, could obviously be replaced by a cam or electric or electronic timing device to establish the unbending movement of the torso at the appropriate time.

A preferred embodiment of this invention has been constructed and illustrated in appended drawings and will be described below to illustrate an actual construction for carrying out the present invention.

DETAILED DESCRIPTION OF THE PREFERRED EMBODIMENT

Figure 1:
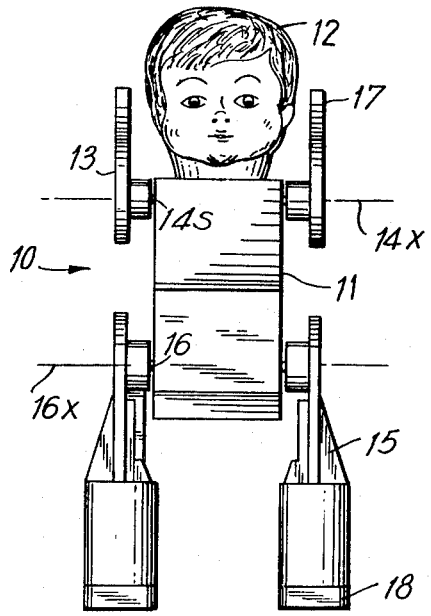
FIG. 1 is a front elevation view of the new doll.
Figure 2:
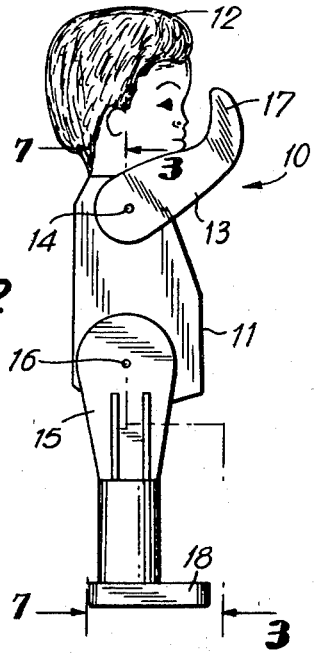
FIG. 2 is a right side elevation view thereof.

The outer appearance of the robot doll of the present invention is illustrated in FIGS. 1 and 2 as follows:

The doll 10 has a basic torso 11, a head 12, arms 13 on arm pivots 14, legs 15 on leg pivots 16, hands 17, and feet 18. The leg pivot 16 rotates about an axis 16X which extends through the bottom of the torso, and the arm pivot 14 pivots about a second axis 14X extending through the upper portion of the torso. In the doll shown the arms and hands are essentially rigid except for being pivotable about axis 14X; the legs and feet are essentially rigid except for being pivoted about axis 16X.

Figure 4:
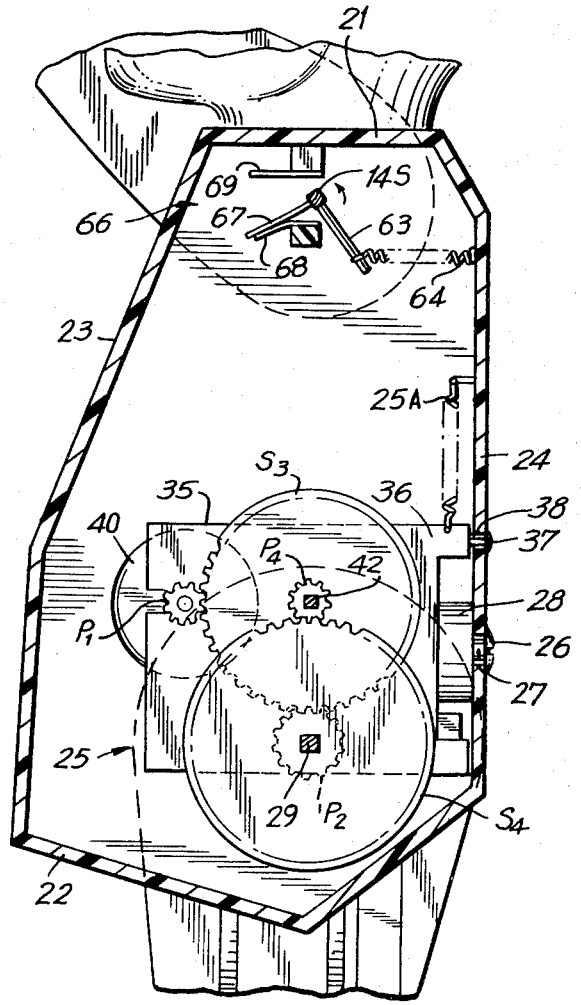
FIG. 4 is a fragmentary side sectional view of the torso taken along line 4—4 of FIG. 3.
Figure 3:
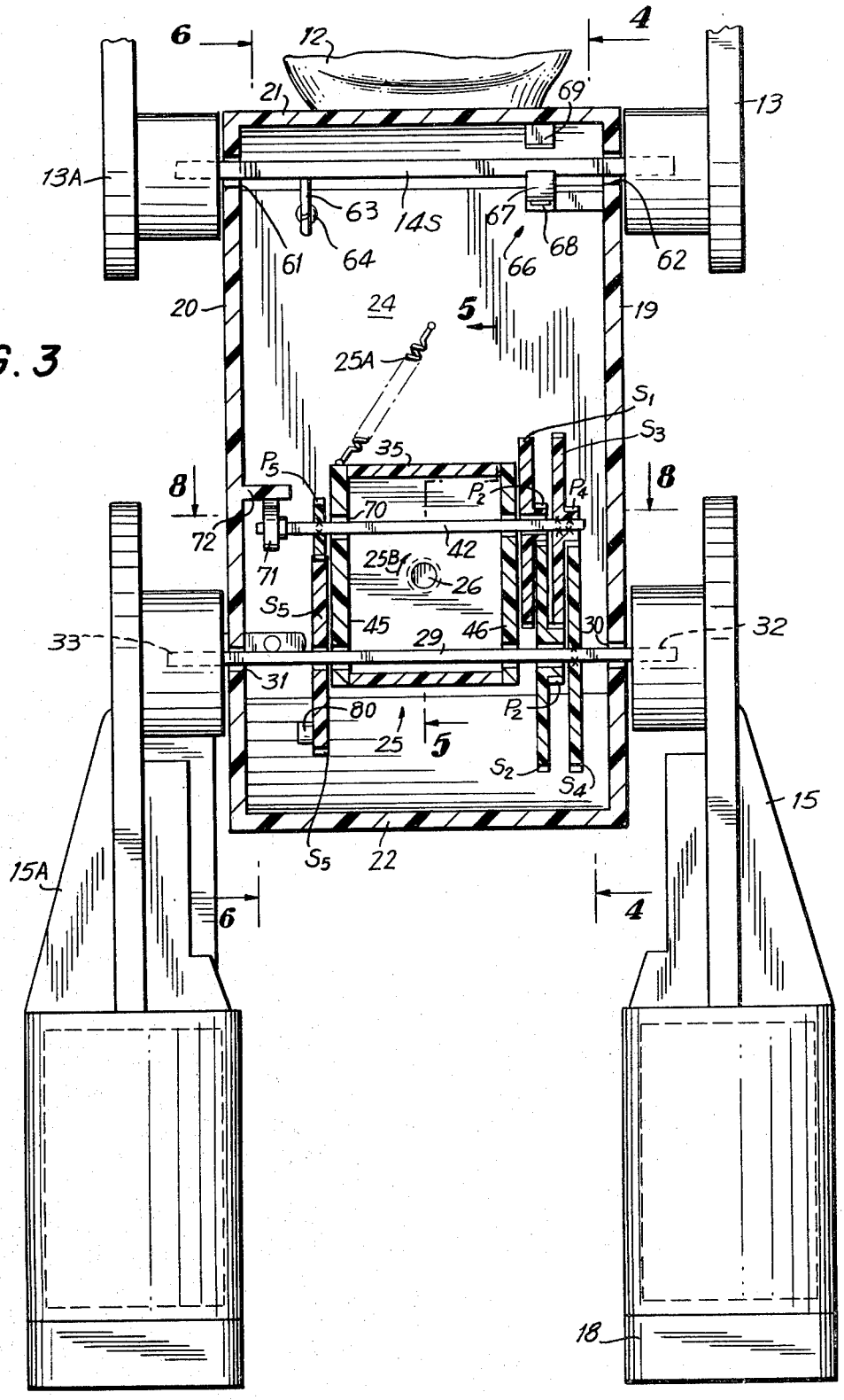
FIG. 3 is a fragmentary front sectional view taken along line 3—3 in FIG. 2.
Figure 5:
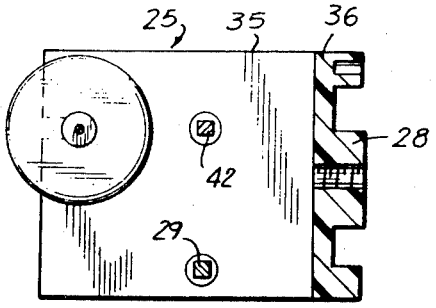
FIG. 5 is a fragmentary sectional view of the mechanism taken along line 5—5 of FIG. 3.
Figure 6:
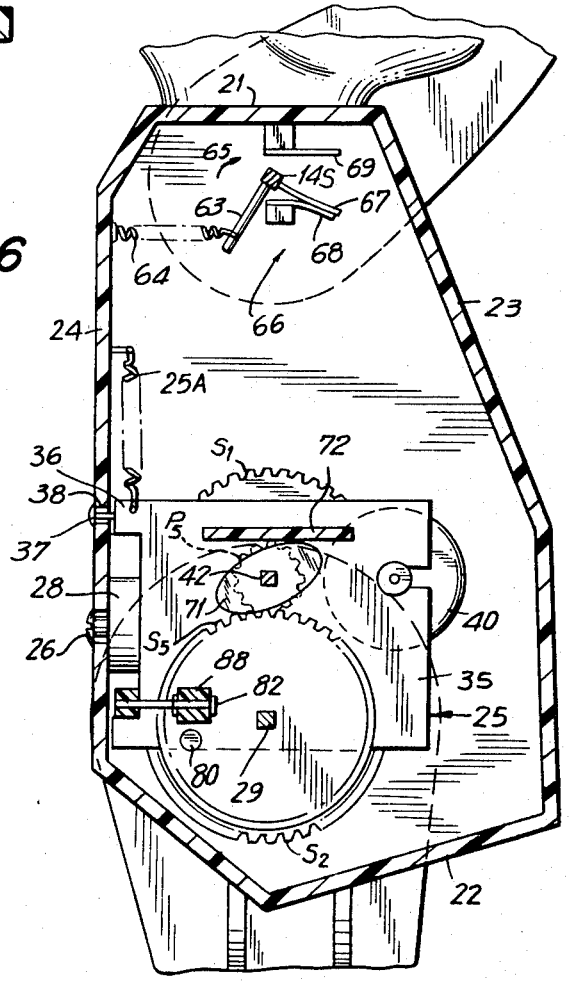
FIG. 6 is a fragmentary sectional view of the torso taken along line 6—6 of FIG. 3.
Figure 7:
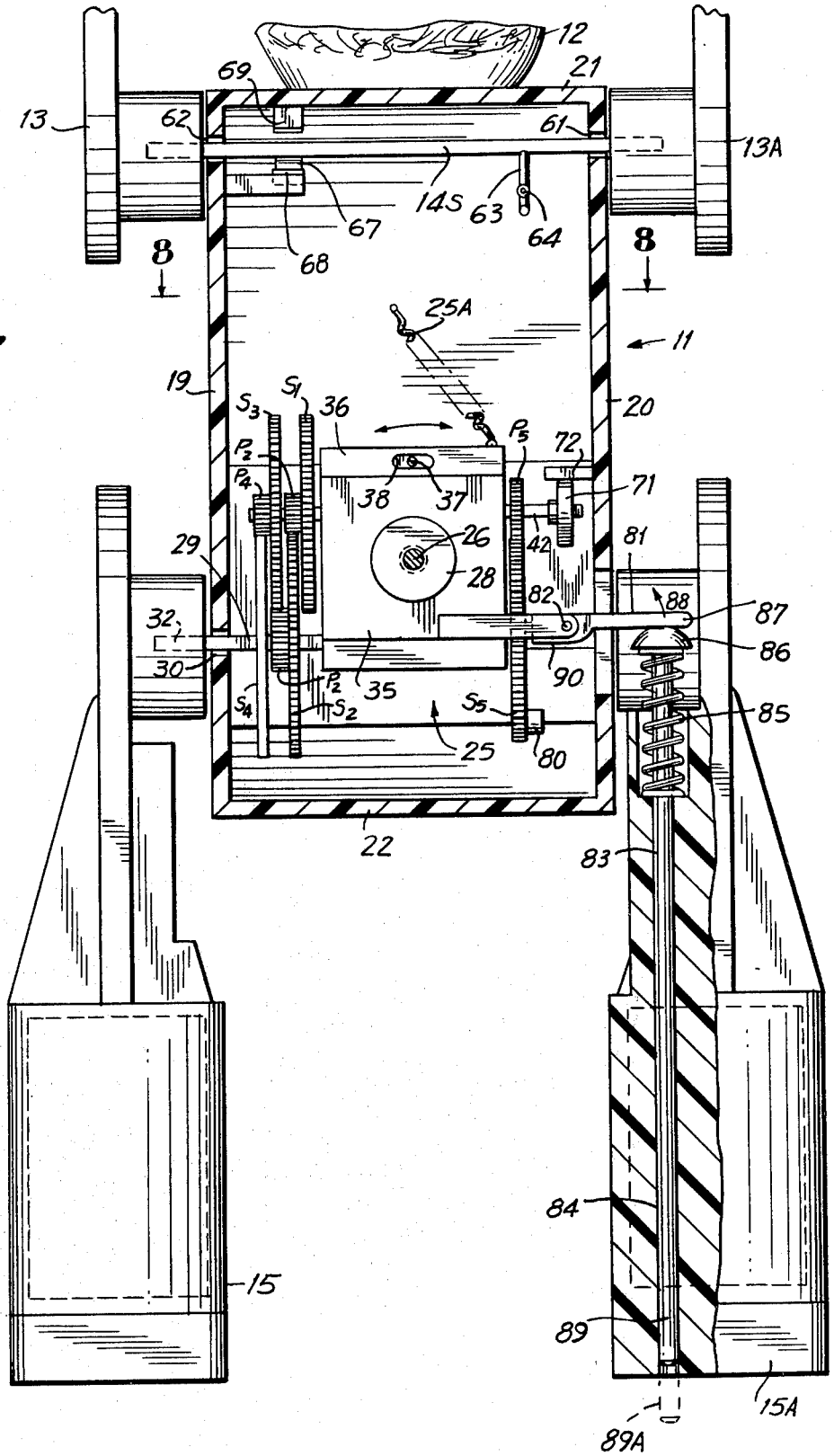
FIG. 7 is a fragmentary rear sectional view taken along line 7—7 of FIG. 2.

The internal construction of this robot is illustrated by the various sectional views provided by FIG. 3 showing a front view within the torso, FIG. 4 showing a leftside view within the torso, FIG. 5 showing a left side view at the middle of the torso, FIG. 6 showing a right side view within the torso, and FIG. 7 showing a rear view within the torso. According to FIG. 3 the torso is formed by a shell having left side wall 19, right side wall 20, top wall 21, bottom wall 22, front wall 23, and rear wall 24, the latter two walls illustrated in FIG. 4. Within the torso is a drive assembly 25 which is mounted to rear wall 24 (see FIG. 4) by the single screw 26 which passes through aperture 27 in wall 24 and engages block 28 of the drive assembly 25. Screw 26 engages block 28 with clearance in hole 27 such that the entire drive unit 25 can pivot or wobble slightly about the axis of screw 25 within the overall torso 11. Extending through the drive subassembly 25 is a basic drive shaft 29 which passes with clearance through apertures 30 in left wall 19 of the torso and aperture 31 in right wall 20 of the torso. This axle 29 fixedly engages the left leg 15 in a coupling 32 and fixedly engages the right leg **15*a* in a similar coupling 33 at the top of a leg. As thus far described, the torso and drive unit 25 within the torso together pivot about axle 29 when appropriately driven relative to the legs 15 and 15*a***.

FIG. 4 shows a further detail of the drive assembly 25, namely a frame 35 to which block 28 has been secured with a further extension 36 into which is inserted screw 37 through an elongated aperture 38 formed in rear wall 24 of the torso. This is best illustrated in FIG. 7 whereby the elongated slot 38 establishes limits for the drive assembly 25 and its frame 35 to pivot slightly, relative to and within the torso 11.

Figure 9:
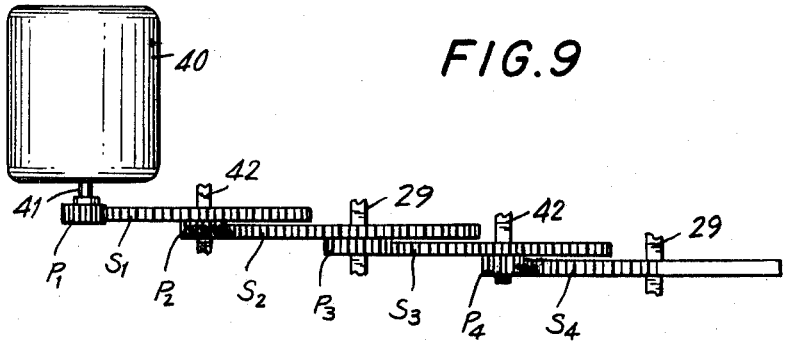
FIG. 9 is a schematic plan view of the gear train of the drive mechanism.

In the drive unit 25 there is a central electric motor 40 with an output shaft 41 and a drive pinion designated $P_1$. The power drive unit will be described with reference to various figures herein, and also FIG. 9 should be observed since it shows a schematic representation of the gear train, although this is obviously out of scale and not in form of the actual unit in the torso.

Pinion $P_1$ engages gear S1 which rotates freely about shaft 42 which is in effect an intermediate shaft or idler between motor drive 40 and the output drive shaft 29. Fixed to gear S1 is a second pinion P2 which engages and drives second gear S2 which freely rotates about drive shaft 29. Fixedly attached to gear S2 is pinion P3 which drives gear S3 which is fixed to shaft 42 and thus causes 42 to rotate continuously when the motor rotates, this shaft passing through both side walls 45 and 46 of the drive unit frame and extending through wall 45 on the right side of the robot to another pinion to be described later.

Gear S3 being fixed on shaft 42 has with it pinion P4 also fixed on shaft 42 which drives gear S4, S4 is fixed to main drive shaft 29 whose ends are fixedly engaged to the legs in couplings 32 and 33.

So far in regard to the power drive described, when the motor 40 runs, rotation of the last gear in line, namely S4, will cause relative movement about axis 16X between shaft 29 and the leg as one entity, and the drive unit frame 25 which is secured to the torso 11 as another entity. Thus, operation of this gear train will cause the torso to pivot about axle 29 relative to the legs during the first getting up movement of the doll robot which was described earlier.

Assuming for the moment that the robot is in the upstanding position with the torso straight up and the legs straight down, it is obvious that control means, to be described later, are necessary for the torso to pivot relative to the legs until an inverted V-shape is established as the doll gets up; further controls must cause the motor to reverse directions so that the V-shape is opened up and the torso rises relative to the legs in order to achieve a stand up position.

Figure 10:
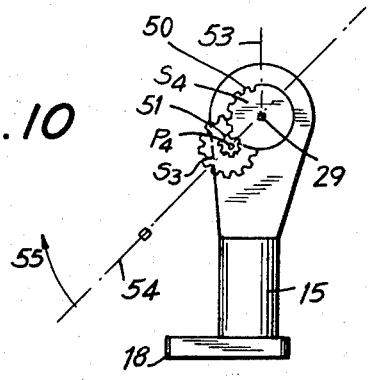
FIG. 10 is a fragmentary schematic view of part of the drive mechanism.

FIG. 10 shows a detail of the left leg 15 on foot 18, with the drive axle 29 shown extending through the top of leg 15 where it is fixedly connected. Also, fixed to this shaft is gear S4 referred to earlier which engages pinion P4 for the actual drive movement of the torso relative to the legs. As shown in FIG. 10 gear S4 has teeth 50 only in an area of about 120° for engagement with all teeth 51 extending completely around pinion P4. FIG. 10 represents the doll when it has partially risen and it is in the V-shaped configuration with the legs fully erect along axis 53 and the torso still extending downward along axis 54. In this position, since the center of gravity has moved backward and the entire doll has tipped backward until the legs arrive in a vertical position, the torso is about to begin to rise upward in a clockwise direction as indicated by arrow 55 in FIG. 10. As indicated in this figure, the gear S4 stands fixed with leg 15 and shaft 29; as pinion P4 rotates it will, in effect, walk up the 120° of gear teeth 50 carrying the torso with it, until it arrives in a vertical position at which time the pinion will disengage from teeth 50 and no longer drive or attempt to drive the torso any farther around. The actual disengagement of teeth at the high point of gear S4 occurs because when the torso reaches an erect position it is balanced to tip slightly to the rear which carries pinion teeth 51 slightly beyond the last tooth 50 and into an area on the periphery of gear S4 that has no teeth.

When the doll falls down as will be explained later, it will have previously been in an upright position with the drive pinion P4 slightly disengaged from the fractionally toothed drive gear S4. However, upon falling the torso will pivot slightly forward so that rotation of the pinion P4 will actually engage the first tooth of gear S4 and again to drive the torso relative to the legs into the V-shaped orientation so that the doll will get up.

Next will be described the reversing switch for the electric motor. As indicated earlier, the arms are fixed to the upper shaft shaft 14S and rotate with it, with the shaft extending through the torso 11 and particularly through aperture 61 in the right wall 20, and aperture 62 in the left wall 19 as illustrated in FIG. 3. Throughout this specification wherever a shaft is shown extending freely through an aperture, it is intended that this be a bearing junction for rotational support of the axle therethrough, and that the axle not simply be in free space as schematically illustrated. Extending down from 14S is a lever 63 fixed to the shaft and illustrated in FIGS. 3 and 4. From lever 63 there is a spring 64 extending to the rear wall 24 of the torso which pulls the arms in a clockwise direction according to arrow 65 in FIG. 6 when looking at the right side of the torso in section. In any event the spring urges the arms generally downward, but when the doll is lying down and the arms engage the ground they will be driven upward against the spring force. Thus when the main circuit is closed and the motor begin to run, it will run in a first direction causing the torso to bend until it reaches a V configuration; then the doll tips backward slightly so that the legs are vertical and the arms come slightly off the ground. At that moment the spring pulls the arms downward which automatically causes a switch to reverse the direction of the motor drive. As described earlier the motor then causes pinion P4 to walk its way up gear S4 causing the torso to rise to its upstanding position. The actual reversing switch is indicated as 66 in FIGS. 3 and 4 where a moveable contact 67 engages either fixed contact 68 or fixed contact 69 to effectuate the circuit reversal.

Figure 8:
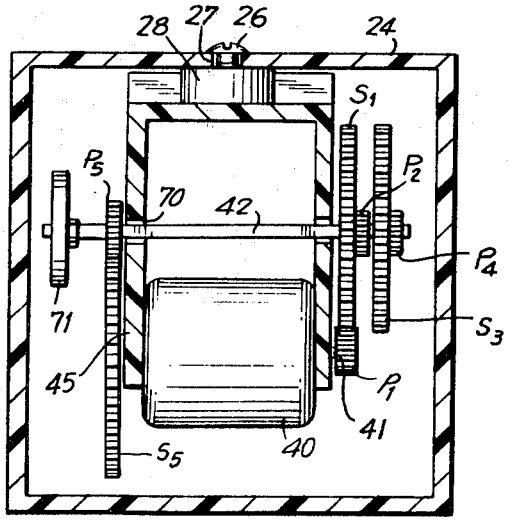
FIG. 8 is a fragmentary sectional view taken along line 8—8 in FIGS. 3 and 7.

Having described how the doll gets up and arrives at a standing position, we will now describe the next phase of its programmed operation. As described earlier and with reference to FIG. 3, there is an upper idler shaft 42 which extends through the drive unit frame 36 and particularly through its right side wall 45 through aperture 70. This is also shown in FIG. 8 which is a top sectional view and where wall 45 is actually the right side wall of the power assembly frame. On the right end of shaft 42 is pinion P5 which is fixed to shaft 42 and outward on this shaft is fixed a cam 71, the cam being generally oblong or egg-shaped. The cam is also shown in FIG. 6 with the end of shaft 42 in the center of this cam. Immediately above the cam is a bar 72 which appears in FIGS. 3 and 7 and is fixedly mounted to sidewall 20 of the torso as best seen in FIG. 3. When the shaft 42 rotates due to rotation of motor 40, the cam will intermittently engage bar 72 whenever the end portions of the cam reach a vertical orientation. Since the drive unit frame 25 is pivotable or wobbles relative to the torso 11 about screw or pivot 26, this cam is the drive force to cause the relative wobbling motion. Such motion becomes apparent when the doll has reached an upstanding condition and the motor continues to run. At this time the torso tips from left to right continuously. Since the torso has a stable balanced state when the cam's short dimension is up and the cam does not contact bar 72, the torso will be driven to its wobble or pivot condition each time the cam's long dimension reaches the high spot and engages bar 72. Spring 25A seen in FIGS. 3, 7, 4, and 6 urges frame 25 clockwise about pivot 26 thus ensuring constant contact of cam 71 with bar 72 for the wobble action.

Finally, we get to gear S5 which appears in FIG. 3 and it is driven by pinion P5 adjacent the cam 71. Gear S5 rotates freely about lower shaft 29 and thus is not affected by the getting up motion of the torso. Near the periphery of gear S5 is a cam pin 80 which also is shown in FIG. 7. Since pinion P5 is so much smaller than gear S5, the pin 80 will make one revolution quite infrequently. When the pin does revolve, however, it will eventually hit a rocker arm 81 which pivots about pivot axis 82 carried by the rear wall 24 of the torso.

Extending down right leg **15*a* as seen in FIG. 7 is a rod 83 axially movable in a guide 84. A spring 85 within the guide 84 urges the rod upward so that its top part 86 engages one end 87 of rocker arm 81 and tips it in a counterclockwise direction indicated by arrow 88 in FIG. 7. When rod 83 is in the up position its lower end 89 would be completely within the guide 84; however, in the dotted position shown in FIG. 7, the rod 84 is driven downward so that its lower end 89A projects out of and beyond the bottom of leg 15*a*. This will occur when cam pin 80 has finally rotated downward and engaged the near end 90 of rocker 81 and caused its remote end 87 to move downward driving the top of rod 83 downward and thus causing projection 89 to extend out of leg 15*a*. When all this happens the leg 15*a* would rise by the amount that rod end 89 extends outward, and cause the entire doll to tip. When this particular tipping of the torso by the leg coincides in a particular manner with the tipping of the torso caused by cam 71, the imbalance will be such as to cause the doll to fall down on its front side. Arms 13 strike the support surface as the doll falls, rotating shaft 14S and actuating the reversing switch 66. At that time the drive pinion P4** will again cause the doll to begin its rising phase.

While not shown it is possible to orient rod 83 in a rearward direction so that when its lower end 89 intermittently extends outward it will drive leg 15 forward instead of upward. In this situation the leg would be driven forward about the other leg 15 and the doll would tend to rotate. If both legs had drive rods, both being oriented rearward and driven intermittently, then the doll would shuffle forward first on one leg then on the other and in fact would walk.

Figure 11:
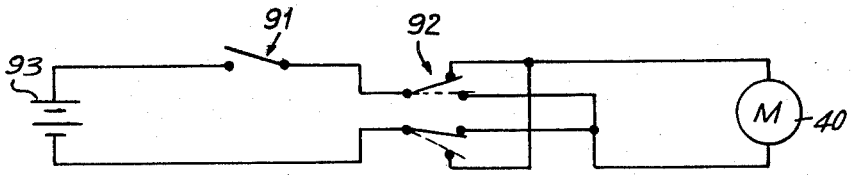
FIG. 11 is a schematic wiring diagram for the doll.
Figure 12:
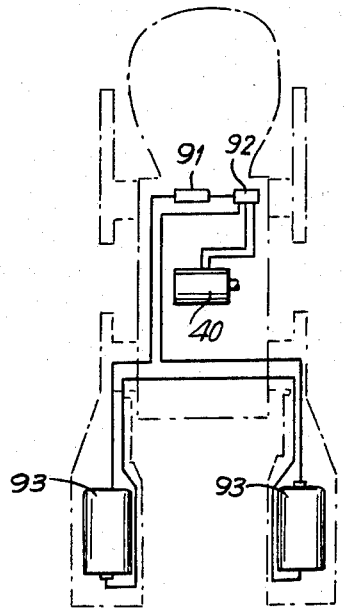
FIG. 12 is a circuit diagram for the drive mechanism.
Figure 13E:
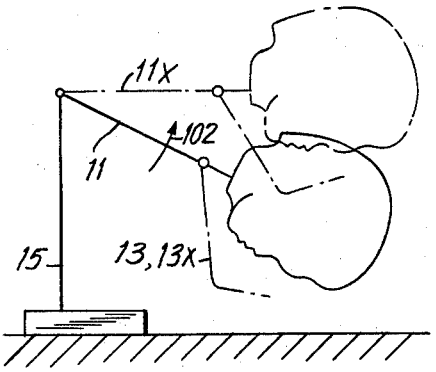
FIG. 13 is a schematic drawing showing a sequence of positions of the doll in rising from prone position.
Figure 13D:
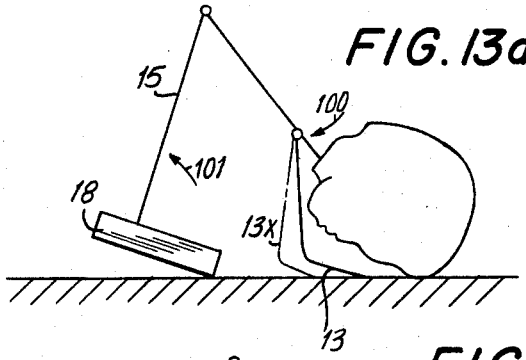
Figure 13C:
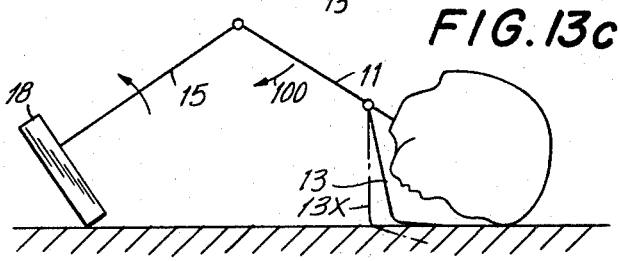
Figure 13B:
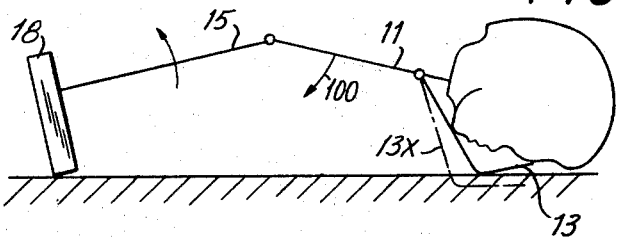
Figure 13A:
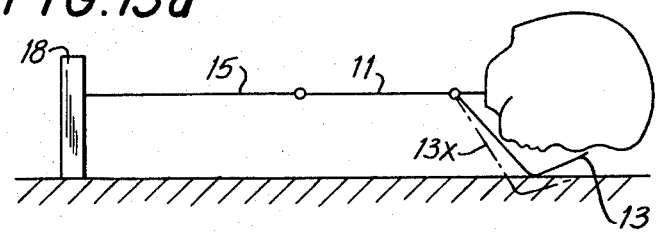
Figure 13F:
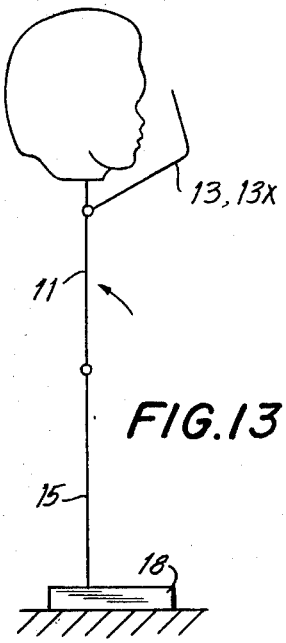
Figure 1:
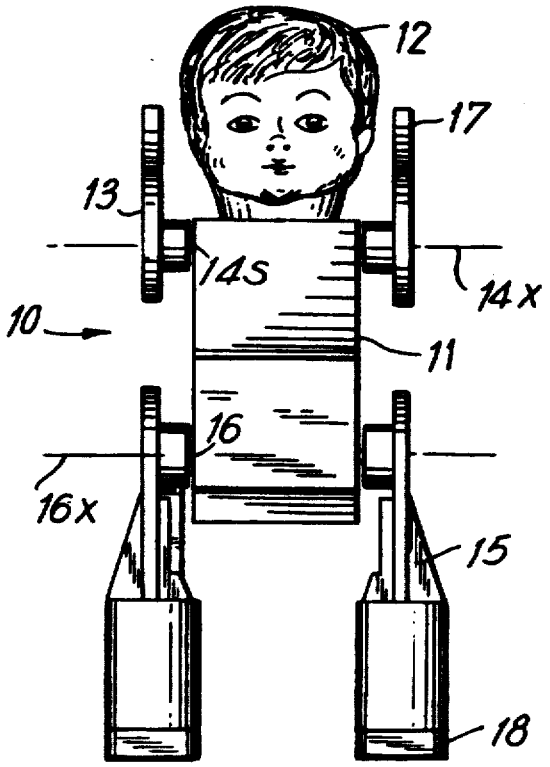

The circuit diagrams of FIGS. 11 and 12 are basically quite simple. The batteries 93 in the legs are in series with the motor 40 and there is reversing switch 92 on the upper arm shaft 14. Also, there is a main off/on switch 91 for initiating operation of the doll. The reversing switch 92 is represented by parts 66,67,68 and 69 in FIG. 3, for example, and FIG. 4.

FIG. 13 shows in schematic or stick figures a sequence of motions of the doll as it rises through a plurality of V-shaped configurations seen in FIGS. **13*b*–13*e*. In 13*a* the doll is lying prone on the ground with its arms 13 shown in solid line and dotted line 13*x* shown to indicate the position that the arms will later take when they pivot downward pursuant to the spring force. FIG. 13*b* shows the torso 11 beginning to move clockwise according to arrow 100 relative to legs 15. FIG. 13*c* shows further motion as the torso and legs approach the V-shape wherein the V is subtended by the generally horizontal support surface and torso continues to move in the clockwise direction of arrow 100. FIG. 13*d* continues the same. In FIG. 13*e* the center of gravity has tipped so that the entire doll has pivoted or tipped in a counterclockwise direction according to arrow 101 in FIG. 13*d* about foot 18 in that figure; accordingly the doll is now standing in FIG. 13*e* with its legs 15 erect and its torso 11 still in the V-shape. At this time however, the arms 13 have come off the ground and so the spring 64 is able to cause them to pivot to position 13*x* shown in FIG. 13*e*. With the movement of the arms the motor circuit is reversed and torso 11 begins to rise in a counterclockwise direction according to arrow 102 shown in FIG. 13*e*. The dotted line 11*x* indicates the half way position of the torso 11 as it begins to rise. FIG. 13*f* indicates the final upright position of the doll with legs 15 straight up and torso 11** continuing straight up the legs and torso thus being generally aligned in a generally vertical erect orientation.

The doll robot illustrated herein obviously could have the outer appearance of a male or female infant and could have a great variety of dimensions and proportions, or could represent another creature or even another robot. As contemplated, the materials for constructing this robot are typical plastics, metals, fabric, hair, etc.; in a preferred embodiment the doll would simulate a human by having a soft skin-like exterior that is clothed.

The drive unit shown includes an electric motor with a rotary output shaft operable through a gear train to various cams and levers. In this particular doll the motor is a constant speed, reversible DC motor operable by a 3 volt battery power source. Suitably selected pinion and spur gears in the gear train shown produce a reduced speed of rotation of the final gear in the torso relative to the mating gear in the legs as the legs and torso first bend into a V-shape and then unbend to a straight line configuration. Many alternative power sources and drive systems are possible including electric solenoid drives, mechanical spring systems, thermodynamic systems, etc.

In the preferred embodiment of this invention the doll has human-like features, however in practice the legs or leg means could comprise a single leg or two or more legs; also the arms or arm means could comprise a single arm, or two or more arms. In the figures shown herein, the legs are pivotable only at the hip joint, the arms are pivotable only at the shoulder joint, and the toes, ankles, knees, elbows, hands, wrists, fingers, waist, and neck are not articulatable. For automatic movement, we have referred to wobble means for tipping of the torso relative to the legs, and a tipping means for tipping the legs relative to the ground, floor or other reference plane. The various motions, drives, and controls are employable independently of each other or in any combination. The drive means is conveniently an electric motor with batteries in the dolls legs. Other electric current source could be used, such as an external source connected by a power cable, or a purely mechanical drive means. Variations are also possible from the pinion and spur gear arrangement illustrated herein, where a fixed spur gear with about 120° of teeth from about 8 to 12 o'clock positions coacts with a pinion that "walks" up these spur gear teeth.

The various motions could be programmed electronically; however in all cases, the objective is for the doll or robot to rise from a prone position to a standing position, and alternatively to fall down and rise repeatedly, and/or to walk around. The device disclosed herein accomplishes these objectives and the claims following define the scope of the invention which may encompass numerous variations of the device and its motion.

I claim:

1. A robot doll comprising a torso with a hip part at the bottom thereof, and a 1st axis through said hip part, leg means mounted on said doll and pivotable about said 1st axis; drive means in the torso for causing said leg means and torso to pivot relative to each other, whereby said doll is movable between positions of a series of positions including, with respect to a generally horizontal support surface, at least four positions, namely:

(A) prone face-down with leg means and torso generally aligned, (B) face down with torso and leg means in inverted V-position with hip part elevated, (C) said inverted V-position with said leg means oriented generally vertically, and (D) erect position with said leg means and torso generally aligned and vertical, and 1st switch means for activating said drive means to pivot said leg means and torso causing said doll to move from position (A) to position (B), said doll having configuration and weight distribution such that when the doll moves from position (A) to (B) its center of gravity shifts rearward causing said doll to tip rearward into position (C), and 2nd switch means including means for automatically activating said drive means in response to the arrival of said doll at said position (C) to pivot said leg means and torso from pivoted position (C) to said erect position (D), whereby said doll stands.

2. A robot doll according to claim 1 wherein said drive means comprises an electric motor in said torso and operable with a source of electric current, said 1st and 2nd switch means respectively causing said motor to run forward and backward.

3. A robot according to claim 2 wherein said drive means further comprises at least one pinion gear driven by said motor, said motor and pinion gear carried by said torso and at least one fixed spur gear carried by said leg means and engaged to said pinion, whereby rotation of said pinion causes it to move along the periphery of said spur gear thereby causing said torso to pivot relative to said leg means.

4. A robot doll according to claim 3 and operable on a floor, wherein said torso further comprises (a) a second axis at the top thereof (b) arm means having a shoulder part pivotably about second axis between a 1st position where said arm means is relatively close to the torso and a 2nd position where said arm means is pivoted forward of said torso, said arm means being connected to said 2nd switch which is activated when said arm means is pivoted to its 2nd position thereby causing reversal of said motor with only said 1st switch means being operable when said arm is in its 1st position, (c) means biasing said arm means toward its 2nd position, said arm means being urged to its 1st position when said doll is in it (A) and (B) positions face-down with said arm means contacting the floor and the weight of said torso overcoming said biasing means and urging said arm means to its 1st position allowing operation of the motor forward by the 1st switch until the doll reaches its position (C) when said arm means rise off the floor, said biasing means urges the arm means to its 2nd position, said 2nd switch is activated, said motor is caused to run backward, and said torso pivots upward until the doll stands.

5. A robot doll according to claim 2 wherein said electric current source comprises battery means situated in said legs with circuitry connecting said battery means, motor and 1st and 2nd switches.

6. A robot doll according to claim 1 further comprising wobble means for causing said torso to wobble alternatively from side-to-side, while said doll is in said position (D)

7. A robot doll according to claim 3 comprising an axle traversing said torso and fixed to said legs, said drive means comprises a frame carrying said motor and pinion gear, said frame drive means and legs being pivotable together about said axle relative to said torso, said frame and torso being slightly pivotal relative to each other about a 3rd axis transverse to said axle, said doll further comprising wobble means for causing said torso to wobble alternatively from side to side about said 3rd axis and relative to said legs.

8. A robot doll according to claim 7 wherein said wobble means further comprises cam and eccentric follower means mounted on said torso and leg means respectively, the cam driven by said motor thereby causing said torso to wobble according to the cam's eccentricity.

9. A doll according to claim 1 further comprises tipping means for causing said leg means to tip, thereby tipping the torso correspondingly.

10. A doll according to claim 9 wherein said tipping means comprises a rod axially moveable in said leg means, said rod having a lower end that is extendable below the end of said leg means thereby causing said leg means to rise, said tipping means further comprises a drive element periodically actuated by said motor to drive said rod downward in said leg means.

11. A doll according to claim 9 wherein said leg means comprises two spaced apart legs, said tipping means comprises a rod, as defined, in each of said legs, said motor coupled to said rods for actuating said rods alternatively.

12. A doll according to claim 11 wherein said rods are directed at least partially rearwardly of said legs, whereby said alternating extension of said rods causes the respective leg to move forward, thereby causing said doll to simulate forward walking.

13. A doll according to claim 6 further comprising tipping means for causing said leg means to tip independently of said torso's wobbling relative to said leg means, said tipping means being programmed to tip said torso occasionally simultaneously when said wobble means tips said torso relative to said leg means, the combined effect causing said doll to fall from its position (D) to position (A).

14. A doll according to claim 3 wherein said spur gear fixed to said leg means has teeth only for about 120° from 8 to 12 o'clock positions on the spur gear when said leg means is upright, whereby said pinion gear engages said spur gear teeth from said 8 to 12 o'clock positions as said doll moves from positions (C) to (D).

15. A doll according to claim 14 wherein said torso, when arriving at the 12 o'clock position has sufficient momentum to continue movement slightly past the 12 o'clock position where the spur gear has no more teeth, thereby disengaging the drive relationship therebetween.

16. An articulatable figure comprising a 1st member with top and bottom parts, a second member with top and bottom parts, the bottom part of the 1st member and the top part of the 2nd member being pivotally connected about a pivot joint, drive means in one of said members for causing these members to pivot relative to each other, whereby said figure is moveable between positions of a series of positions including, with respect to a generally horizontal support surface, at least four positions, namely;

(A) prone, face down with 1st and 2nd members generally aligned, (B) face down with 1st and 2nd members in inverted V position with pivot joint elevated, (c) said V position with said 2nd member oriented generally vertically, and (D) erect position with said 1st and 2nd members generally aligned and vertical, 1st switch means for activating said drive means to pivot said members, causing said figure to pivot from position (A) to (B), said figure having configuration and weight distribution such that when the figure moves from position (A) to (B) its center of gravity shifts rearward causing the figure to tip rearward into position (C), and 2nd switch means including means for automatically activating said drive means in response to the arrival of said doll at said position (C) to pivot said members from position (C) to said erect position (D), whereby said figure stands.

17. An articulatable figure comprising a 1st member with top and bottom parts, a second member with top and bottom parts, the bottom part of the 1st member and the top part of the 2nd member being pivotally connected about a pivot joint, drive means in one of said members for causing these members to pivot relative to each other, whereby said figure is moveable between positions of a series of positions including, with respect to a generally horizontally support surface, at least four positions, namely:

(A) prone, face down with 1st and second members generally aligned, (B) face down with 1st and 2nd members in inverted V position with pivot joint elevated, (C) said V position with said 2nd member oriented generally vertically, and (D) erect position with said 1st and 2nd members generally aligned and vertical, 1st switch means for activating said drive means to pivot said members, causing said figure to pivot from position (A) to (B), and 2nd switch means including means for automatically activating said drive means in response to the arrival of said doll at said position (C) to pivot said members from position (C) to said erect position (D), whereby said figure stands.

18. An articulatable figure comprising:

a first member with top and bottom sections, a second member with top and bottom sections, the bottom section of said first member and the top section of said second member being pivotally connected about a pivot joint, drive means in one of said members for causing said members to pivot relative to each other, whereby said figure is moveable from a first position wherein said 1st and 2nd members are aligned generally horizontally on a generally horizontal support surface into a second position wherein an inverted V is formed by said members, the V being subtended by said support surface, to a third position wherein said second member is oriented generally vertically while said members are in said V shape, to a fourth position wherein said members are aligned generally vertically, the figure then being substantially erect, first switch means for activating said drive means for driving said members to pivot from said 1st position sequentially into said 2nd and 3rd positions, and second switch means for automatically activating said drive means in response to a condition wherein said members are in said 3rd position for pivoting said members from said third position to said fourth position, whereby said figure is substantially erect.

* * * * *

REEXAMINATION CERTIFICATE (1444th)

United States Patent [19]

Bart

[11] B1 4,349,987

[45] Certificate Issued Apr. 2, 1991

[54] DOLL WHICH RISES FROM PRONE TO STANDING POSITION

[76] Inventor: Philip D. Bart, 9864 NW. 13th Ct., Coral Springs, Fla. 33065

Reexamination Request:
No. 90/001,305, Aug. 7, 1987

Reexamination Certificate for:

| | |
|---|---|
| Patent No.: | **4,349,987** |
| Issued: | **Sep. 21, 1982** |
| Appl. No.: | **169,675** |
| Filed: | **Jul. 17, 1980** |

[51] Int. Cl.[5] ..... A63H 11/18
[52] U.S. Cl. ..... 446/355
[58] Field of Search ..... 446/354, 355, 353, 352, 446/268, 324, 325

[56] References Cited

U.S. PATENT DOCUMENTS 2,147,215 2/1939 Price ..... 446/355 X

FOREIGN PATENT DOCUMENTS 2380045 9/1978 France ..... 446/355

*Primary Examiner*—Mickey Yu

[57] ABSTRACT

A robot doll with an internal drive unit for automatically causing the doll in prone face-down position to bend at the waist until reaching a semi-erect position, then to straighten-up to a standing position, and then to wobble from side-to-side, or to simulate walking, and/or to fall down. A first switch actuates the doll to move from prone position to standing. A reversing switch, actuated as the doll stands, reverses the drive motor to complete standing action. A rod is reciprocated in and out of at least one foot to simulate walking actions and to cause the doll to tip. An interior frame carrying an electric motor and gears is loosely mounted and a cam mounted thereon causes the frame, hence the doll, to wobble while in the standing position. The doll eventually falls from standing position and impacts its pivoted arms on the support surface. This opens a reversing switch and starts the series of moves over again.

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–18 is confirmed.

* * * * *